United States Patent [19]

D'Hooge

[11] 4,069,544

[45] Jan. 24, 1978

[54] ELECTRICALLY ACTUATED DOOR HOLDER AND RELEASE

[75] Inventor: Richard E. D'Hooge, Wood Dale, Ill.

[73] Assignee: Rixson-Firemark, Inc., Franklin Park, Ill.

[21] Appl. No.: 780,326

[22] Filed: Mar. 23, 1977

[51] Int. Cl.[2] ..... E05F 3/00

[52] U.S. Cl. ..... 16/49; 292/263; 16/48.5

[58] Field of Search ..... 16/49, 48.5, 82, 83, 16/64, 65, 70, 80; 292/263

[56] References Cited

U.S. PATENT DOCUMENTS

| | | | |
|---|---|---|---|
| 3,415,562 | 12/1968 | Petersen | 16/48.9 X |
| 3,696,462 | 10/1962 | Martin | 16/49 |
| 3,729,770 | 5/1973 | Lasier | 16/48.5 |
| 3,729,771 | 5/1973 | Crane et al. | 16/48.5 |
| 3,771,823 | 11/1973 | Schnarr | 16/49 |
| 3,777,423 | 12/1973 | Coulter et al. | 16/48.5 X |
| 3,796,451 | 3/1974 | Schultz | 16/82 X |
| 3,935,614 | 2/1976 | Pannone et al. | 16/49 |

*Primary Examiner*—Ronald Feldbaum

[57] ABSTRACT

This disclosure relates to an electrically actuated door holder and release for the multi-point holding of a pivoted door at selected door opening angles, and for the release of a held door either electrically or in response to manual override. The door holder and release includes a rotatable spindle adapted to be connected to a pivoted door which is either push or pull-side mounted. The holder and release comprises a spindle gear assembly having a pair of male spline gears with each gear having a circular ring of splineways forming a series of male projecting keys. A pair of cams, each having cam lobes defining detent segments with each cam having a circular hole internally grooved to mate with the projecting keys of spline gear, is mounted on the shaft. A pair of springs yieldingly hold the cams into mating positions with associated spline gears to rotate therewith. A double lever having a common pivot or fulcrum carries a roller which follows the cams. The lever may be electromagnetically actuated and released to effect a door hold and release, or alternatively, the lever may be manually overridden. The selected hold-open angles may be set and altered, without removal of the holder and release or the associated door closer from their fixed positions on a header frame and door, respectively. This function is attained by the arrangement of the cams on the spline gears in association with depressible springs which enable the cams to be manually adjusted without removal of any component except the housing cover.

9 Claims, 17 Drawing Figures

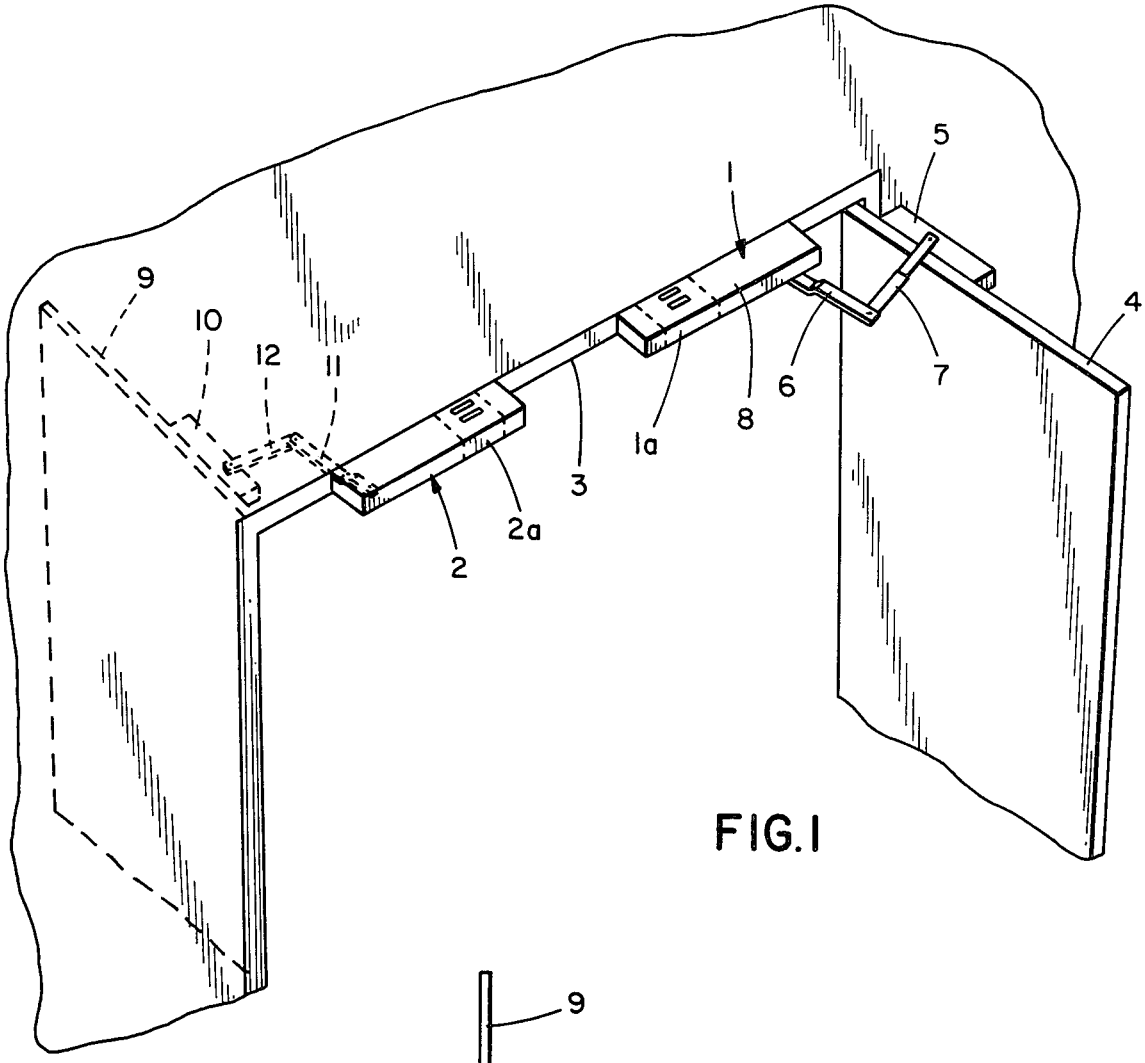
FIG.1
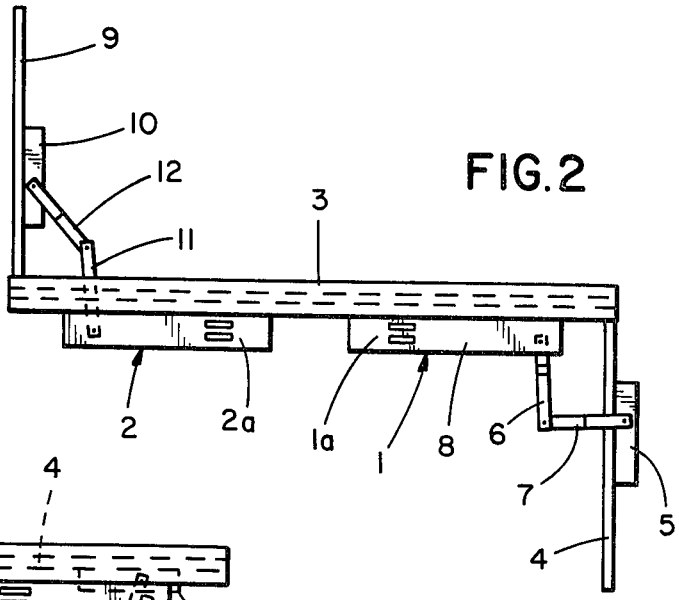
FIG.2
FIG.3
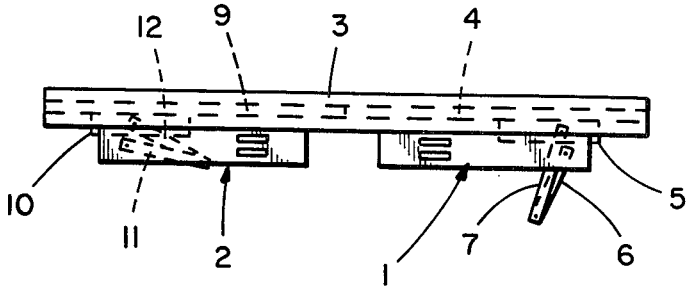

ELECTRICALLY ACTUATED DOOR HOLDER AND RELEASE

FIELD OF THE INVENTION

This invention relates to an electrically-actuated door holder and release for the multi-point holding of a pivoted door at one or more selected door-open angles. It provides for the release of a held door either electrically or in response to a manual override.

BACKGROUND OF THE INVENTION

The concept of smoke-actuated door control has become a proven technique required today by most of the nation's model building codes. These codes specify that the control must be applicable to the doors which may be left open occasionally or at all times; because in many instances it is desirable both to hold a door in an open position to permit adequate air flow or free flow of traffic. The prior art is prolific in electrically-actuated door holder and release devices. Many of these devices include an electrically actuated control which releases the hold-open mechanism. Devices of this type are shown, for example, in U.S. Pat. Nos. 3,164,404; 3,415,562; 3,729,770; 3,796,451; and 3,926,461.

SUMMARY OF THE INVENTION

This invention relates particularly to the structure for effecting door hold-open at any desired angle generally throughout a specified range. The hold-open may be a single-point hold-open or a multi-point hold-open as is desired. Additionally, the device is adapted for push or pull-side mounting and provides for the release of the door either electrically or by manual override.

A principal structural feature of the invention relates to the particular spindle gear assembly which actuates one or more cams in cooperation with a cam follower roller which is mounted on a complex double lever. The spline gear assembly is so designed that adjustments in single or multi-point hold-open positions can be effected without removal from the mounted holder and release mechanism from its supporting frame. The structure is so designed that after the housing cover is removed, cams located on the spindle gear assembly can be manually moved upwardly or downwardly as the case may be, and rotated to effect the proper hold-open position.

Alternatively, if the hold-open positions are already defined by cam locations and changes are required, such changes may be simply made by movement of the cams manually in small increments of the order of 5° so that a precise desired hold-open position or positions can be attained without complex procedures which require removal of the holder and release unit from its support.

DETAILED DESCRIPTION OF THE DRAWINGS

In order that all of the structural features for attaining the objects of this invention may be readily understood, reference is herein made to the accompanying drawings wherein:

FIG. 1 is a simplified perspective view of a corridor opening employing two electrically-actuated holder and release units of this invention associated with door closers and optional smoke detectors (one holder-release is shown in a door pull-side mounting and the other is shown in a door push-side mounting);

FIG. 2 is a plan view of the structure of FIG. 1 with both doors held at an approximate 90° opening angle;

FIG. 3 is a view related to FIGS. 1 and 2 modified, however, to show both doors in a closed position;

Figure 13:
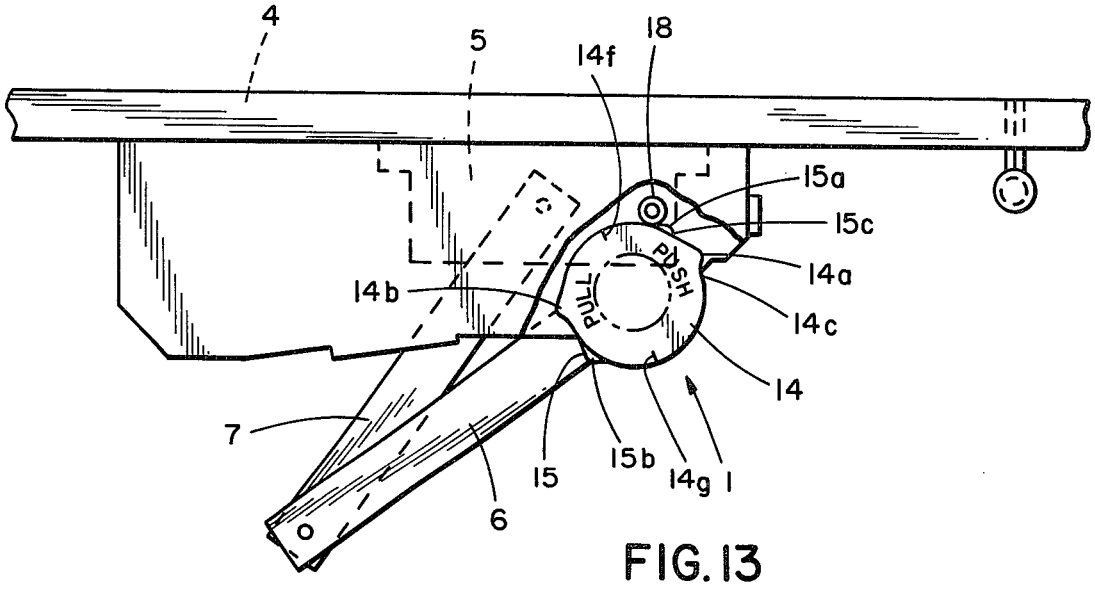
Figure 14:
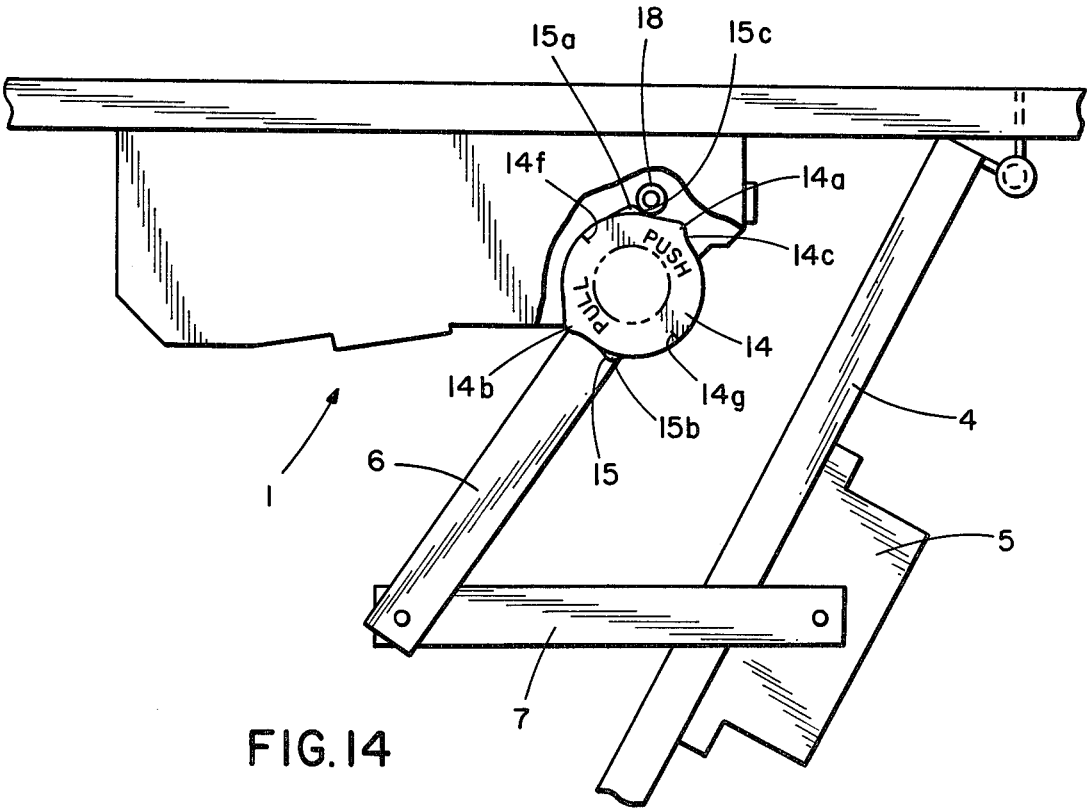
Figure 15:
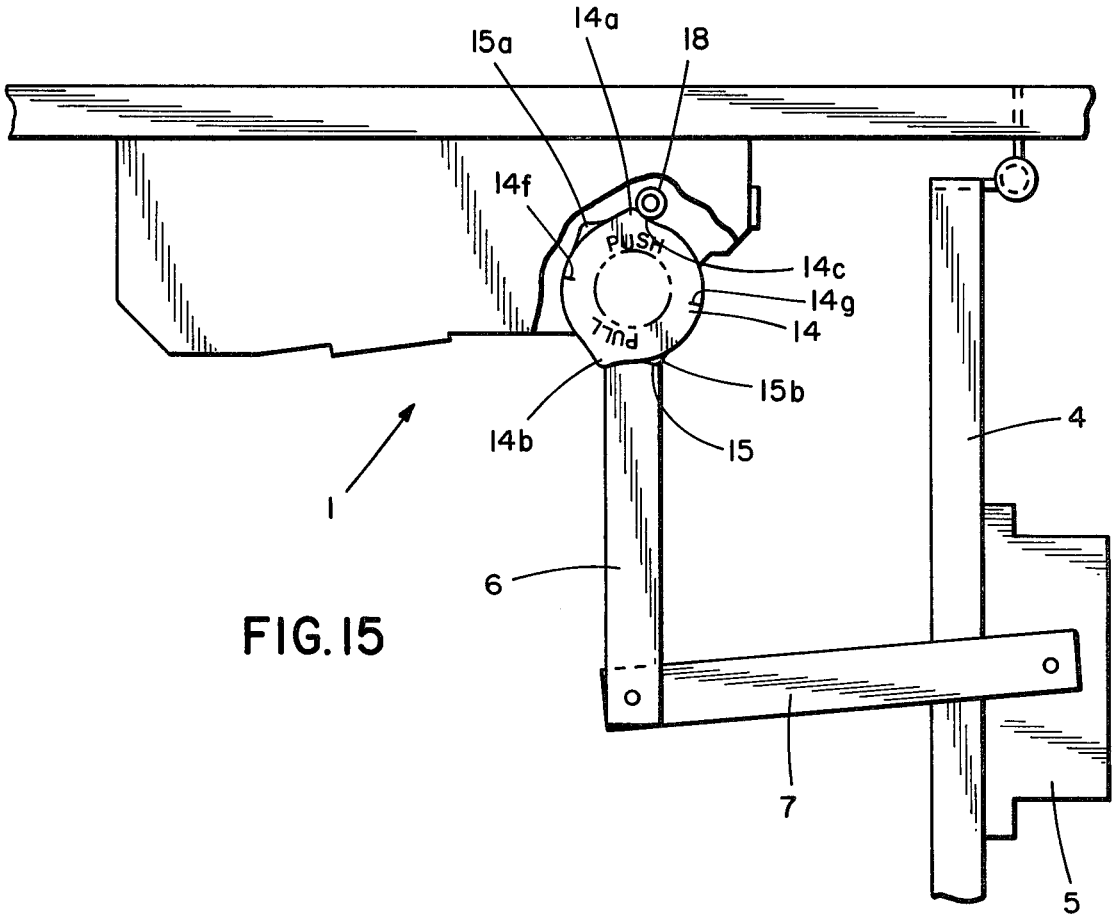
Figure 16:
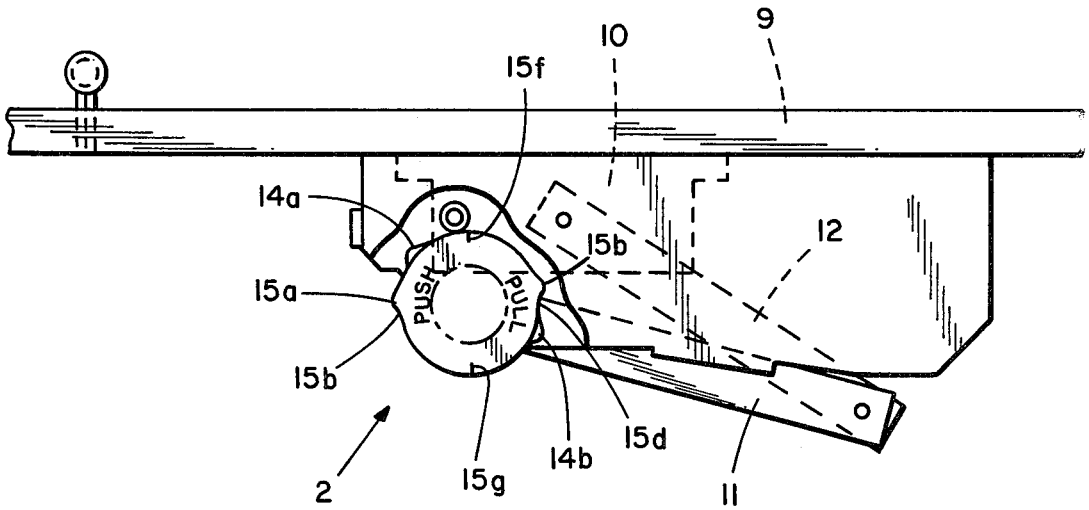
Figure 17:
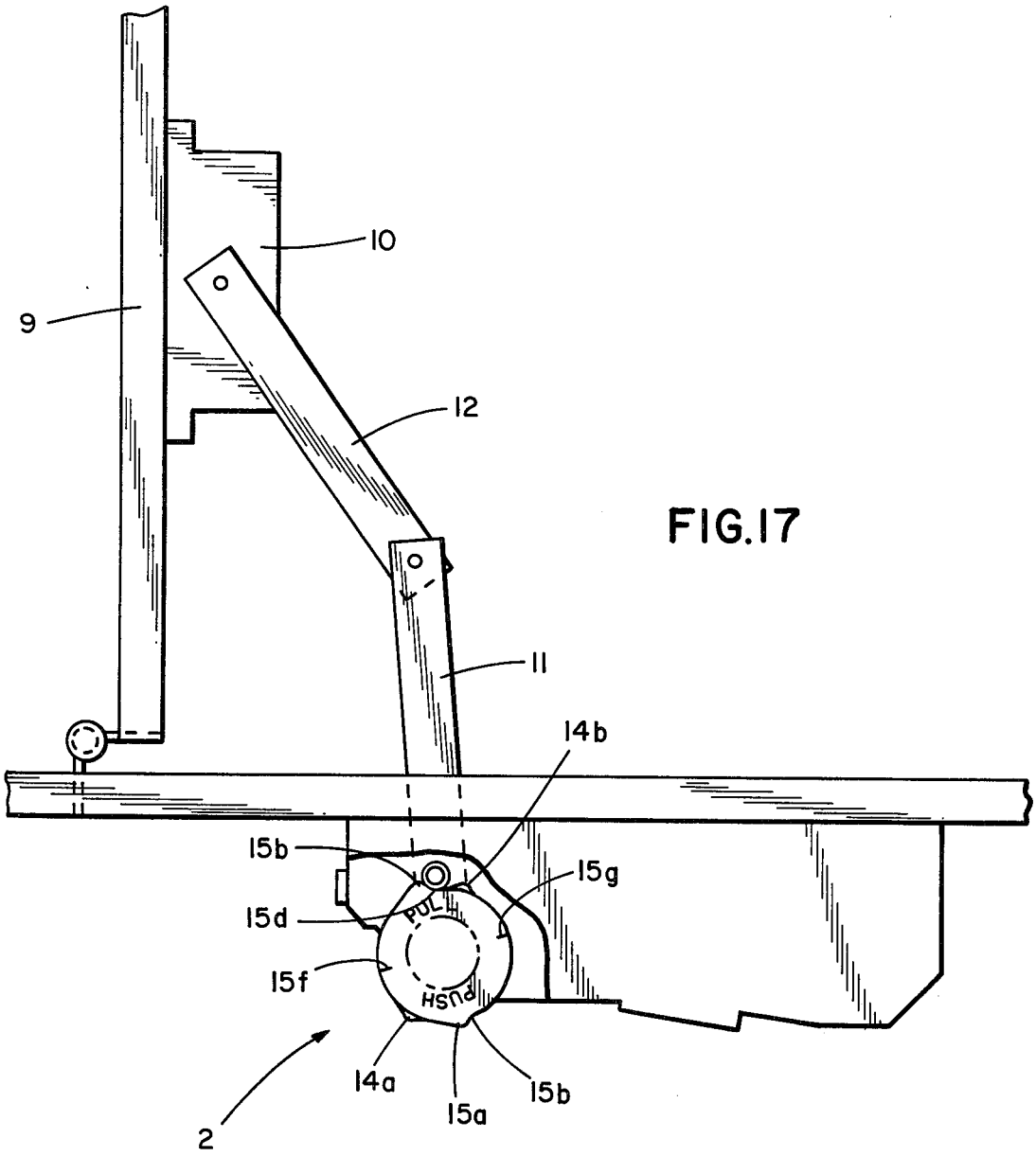

FIGS. 13, 14 and 15 are a set of related operational drawings showing two-point, hold-open sequences for a pull-side mounted holder and release in which FIG. 13 shows a closed door, FIG. 14 an approximate 35° hold-open door position, FIG. 15 an approximate 90° hold-open position; and FIGS. 16 and 17 are a set of related operational drawings showing a single-point, hold-open sequence for a push-side mounted holder and release in which FIG. 16 shows a closed door, and FIG. 17 an approximately 90° hold-open door position.

DETAILED DESCRIPTION OF THE PREFERRED EMBODIMENT

Briefly described, the present invention contemplates an electrically-actuated door holder and release for the single or multi-point holding of a pivoted door at selected door opening angles. Additionally, the device permits the release of a door holder either electrically or in response to a manual overriding force applied to a controlled door.

In general, the door holder and release is non-handed and may be installed at a door header pull-side mounted or push-side mounted.

In the pull-side mounted installation, a preferred embodiment provides for a one point hold which may be typically in a range of 85° to 135°, or alternatively, in a range of 130° to 180°. A two point hold may also be attained in a pull-side mount. The two hold-open angles may typically be (1) approximately 35° and (2) within a range of 85° to 135°.

In the event the holder release is installed push-side mounted, a single point hold-open is attained within a selected range of between 85° to 105°.

The door holder and release mechanism is contained within a housing which is preferably surface mounted upon a door frame header. An arm couples the door holder and release to a conventional closer which is surface mounted upon the controlled door. The standard arm or arms for the push and pull-side mounting applications of the holder and release are the two-piece, jack-knife type common to most surface closers. An optional slide-type arm may also be applied for use with a floor closer application which is not shown.

As is hereafter described in detail, the hold-open function is directly attained by the use of plate-like cams which may be manually rotated on a spline gear assembly to effect one or two point selectable hold-open functions. The cams may be rotated while the holder and release is applied to the door header without resort to disassembly of the device or removal from the frame header. The cams provide an approximate 5° adjustment increments so that the door hold-open positions can be varied in small increments within the general ranges previously described.

The cam adjustment is generally effected after the holder and release is header mounted and power applied to an electromagnet. The energized electromagnet effects a cam latching function. The cams are oriented to the desired hold-open position by a simple manual operation in which the cams are elevated or lowered relative the spline gears and rotated as desired and then reengaged on the spline gears.

This arrangement enables one to mount the entire structure on a door frame and then simply compensate for any variations in the desired hold-open point by a rather simple cam adjustment which can be attained without removing the holder and release as well as the remote closer from their fixed positions on the header frame and door, respectively.

Additionally and as an optional function, a smoke detector module, either ionization or photoelectric, of the general type described in U.S. Pat. Nos. 3,773,423 and 3,908,309 may be incorporated within the same housing as that which contains the holder and release mechanism. With this optional association of the detector, an added life safety function can be provided in the event of smoke passing through the controlled door opening. The detected smoke effects a conventional circuit operation to deenergize the electromagnet so that the holding mechanism is released, thereby enabling the door mounted closer to close the door.

Referring now to FIGS. 1 and 2 of the drawings, pull-mounted electrically-actuated door holder and release 1 and push-mounted electrically-actuated door holder and release 2 are installed on the same side of the header of frame 3. Frame 3 defines a double door corridor opening, and the use of both a pull-mounted door and a push-mounted door in this opening is shown primarily for illustrative purposes in that it facilitates the explanation of the nonhandedness aspect of the holder and release mechanism of the invention. Holder and release 1 effects the control of pull-mounted door 4. Door 4 supports conventional closer-dashpot combination 5; and the jack-knife arm which comprises holder arm 6 and closer arm 7 couples holder and release unit 1 to closer 5. An optional smoke detector module **1*a* is coupled to housing 8 which contains holder and release 1. With this arrangement, any particulate products of combustion passing through the slotted apertures of smoke detector module 1*a* generates an electrical signal which will cause the electromagnetic release of a latching lever hereafter described so that door 4 may be forcibly closed by the operation of closer 5**.

In the 90° hold-open position (FIGS. 1 and 2), door 4 is held open by latching a hold-open cam hereafter described.

Similarly, holder and release 2 is mounted at the header of frame 3; however, this unit is push-side mounted so as to control door 9. Door 9 supports an integral closer-dashpot combination 10 which is typically identical in structure to closer 5. A jack-knife arm including a holder arm 11 and closer arm 12 interconnects holder and release unit 2 to closer 10.

Holder and release 2 may also be optionally provided with a smoke detector module **2*a* similar in construction and function to module 1*a* associated with holder and release unit 1. Accordingly, any particulate products of combustion detected either by module 1*a* or module 1*b* would effect the closing of doors 4 and 9** in a manner which is now well known in the art and described in the aforementioned patents.

Referring to FIG. 3, doors 4 and 9 are shown in the closed position. In view of the fact that holder and release 1 is pull-mounted and holder and release 2 is push-mounted, the associated jack-knife arms for each of the holder and release units 1 and 2 assume different relative positions. For example, arms 6 and 7 associated with mechanisms 1 and 5 project generally outwardly away from the face of holder and release unit 1, whereas arms 11 and 12 are generally aligned lengthwise with the elongated housing for holder and release unit 2. This variation in the position of the jack-knife arms, depending upon whether the holder and release is push or pull-mounted, is compensated for by the structural arrangement for the spindle mounted hold-open cams hereafter described.

Figure 4:
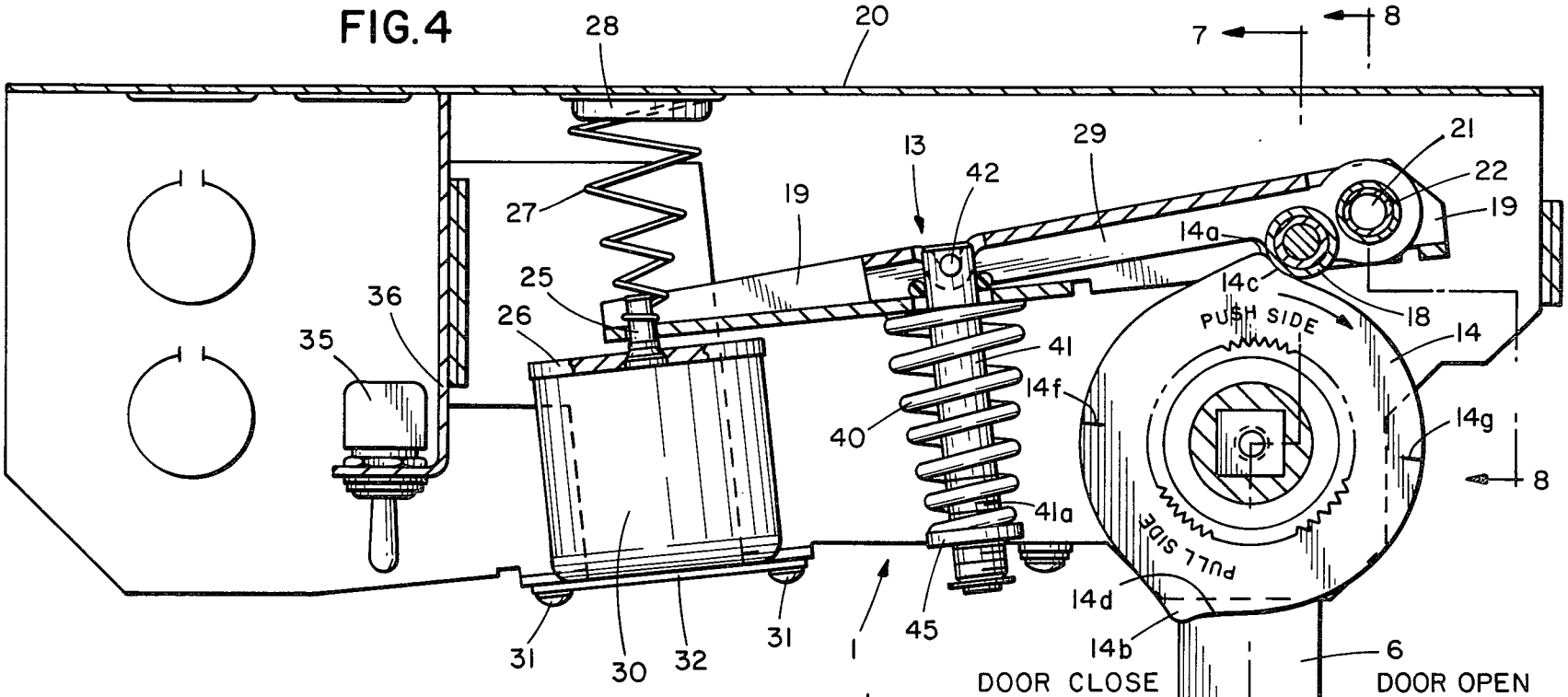
FIG. 4 is a plan view of the pull mounted holder and release with the pull-side cam holding the door open at approximately 90° and with part of the support frame broken away (the optional smoke detector is not shown)
Figure 5:
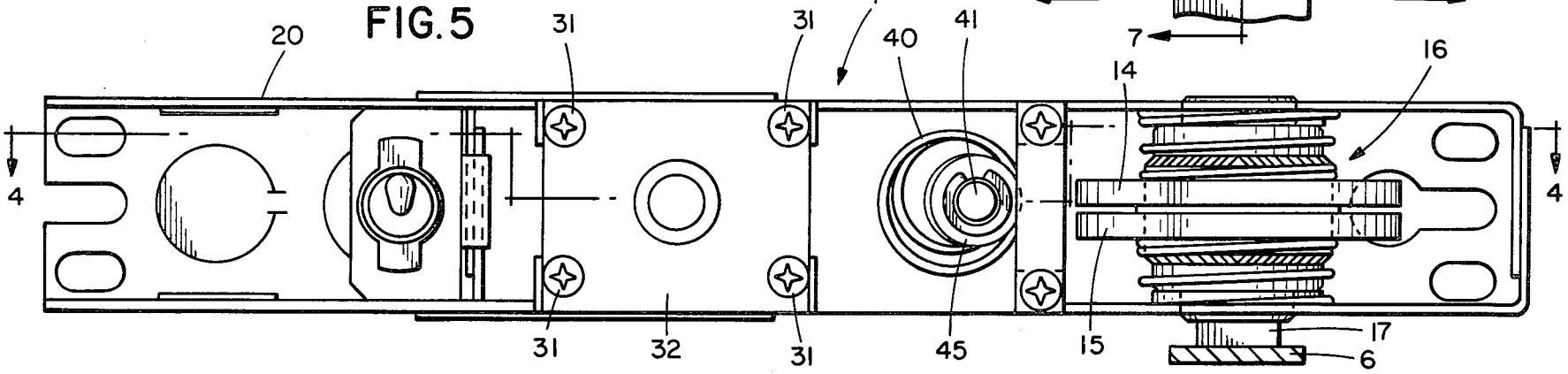
FIG. 5 is a side elevation view of the structure of FIG. 4 which shows both hold-open cams of the spindle gear assembly.

The detailed construction of holder and release unit 1 is shown in FIGS. 4, 5 with the optional smoke detector module **1*a* omitted and also housing cover 8 removed. The primary elements effecting the holding functions are upper cam 14 (FIG. 4) and lower cam 15 (FIG. 5). Both cams are generally circular in constuction and are formed with an integral grooved hole which enables the cams to be seated upon rotatable spline gear assembly 16. Both cams 14 and 15 rotate responsively with movements in holder arm 6 which is connected to the projecting spindle shaft 17 (FIG. 5) of the spline gear assembly 16**.

Referring to the typical plan view of cam 14 (and noting that cam 15 is identical), cam 14 is formed with two projecting lobes **14*a* and 14*b*. The peripheral cam surfaces adjacent and to the right of cam lobes 14*a* and 14*b* are generally concave to form detent or latching pockets or segments 14*c* and 14*d***, respectively.

Pivoted follower roller 18 is shown latched in the detent section **14*c* immediately adjacent cam lobe 14*a*. In this relative disposition of components, door holder arm 6 holds pull-mounted door 4 at an open angle of approximately 90° as is shown in FIGS. 1 and 2**.

Figure 6:
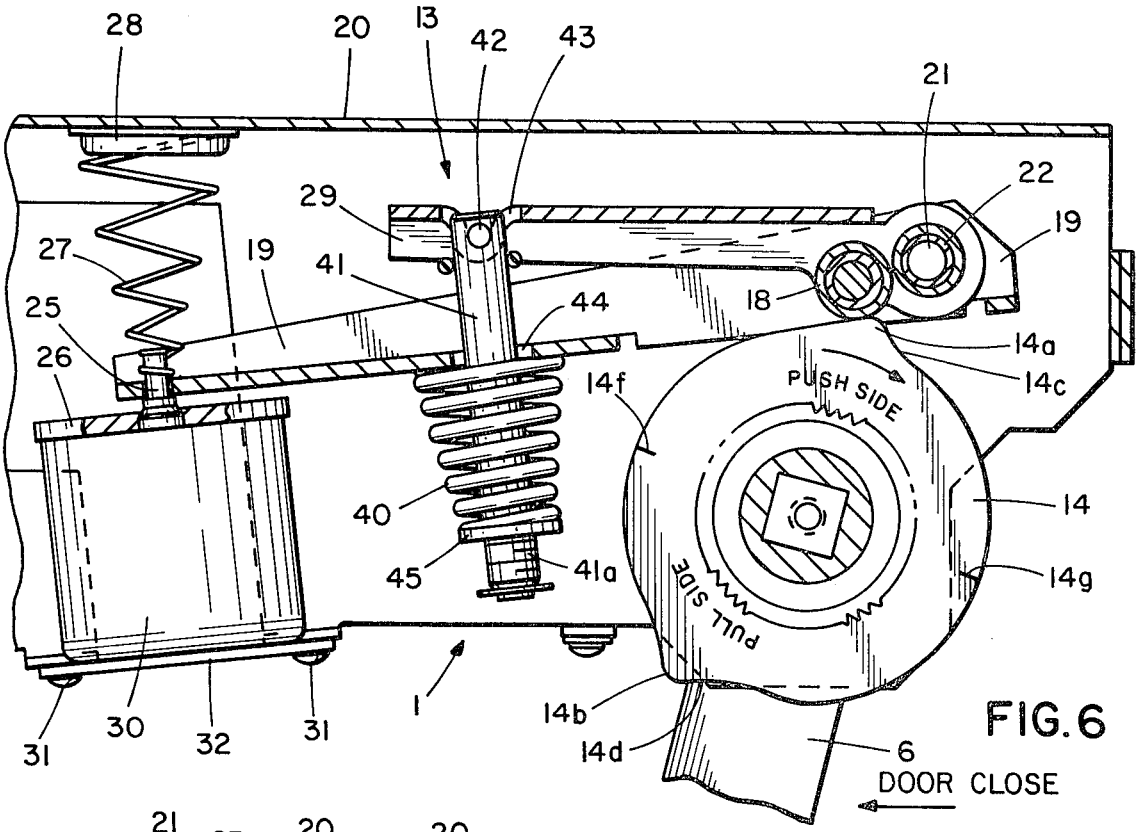
FIG. 6 is an optional view (related to that of FIG. 4) whichshows manual overriding of the hold-open cam by pushing a pull-side mounted door to effect door closing.
Figure 11:
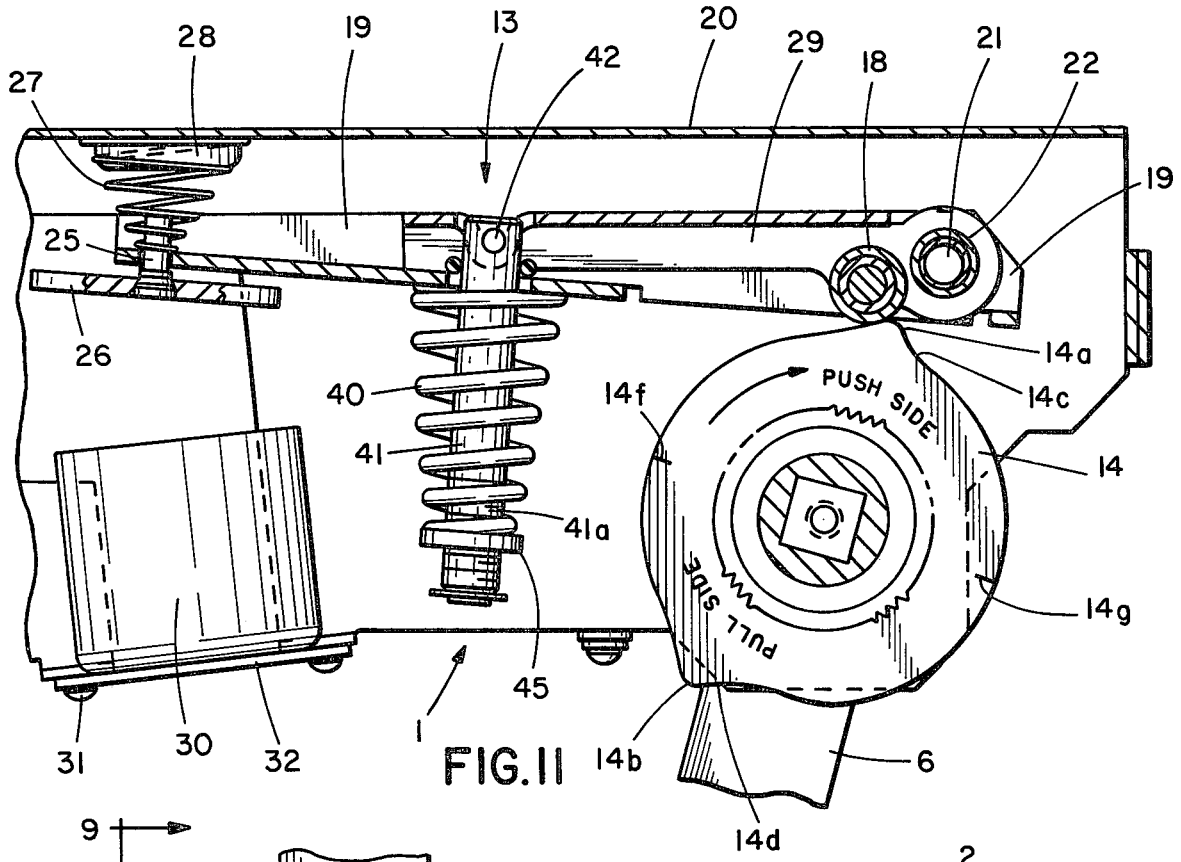
FIG. 11 is an operational view (related to that of FIGS. 4 and 6) in which a pull-mounted holder and release has been electrically deenergized and a door (not shown) is released and moving from a 90° hold-open position to a door closed position.

Cam follower roller 18 may be manually overridden away from or to the latching position as is shown in FIG. 6, or it may be electromagnetically released from its latching position as is shown in FIG. 11. Both of these releasing functions, that is, manual override or electrical release, is effected by a double lever assembly 13 which yieldingly supports cam follower roller 18 for movement in contact with the peripheral surface of cam 14 or releases the roller from such contact.

Figure 10:
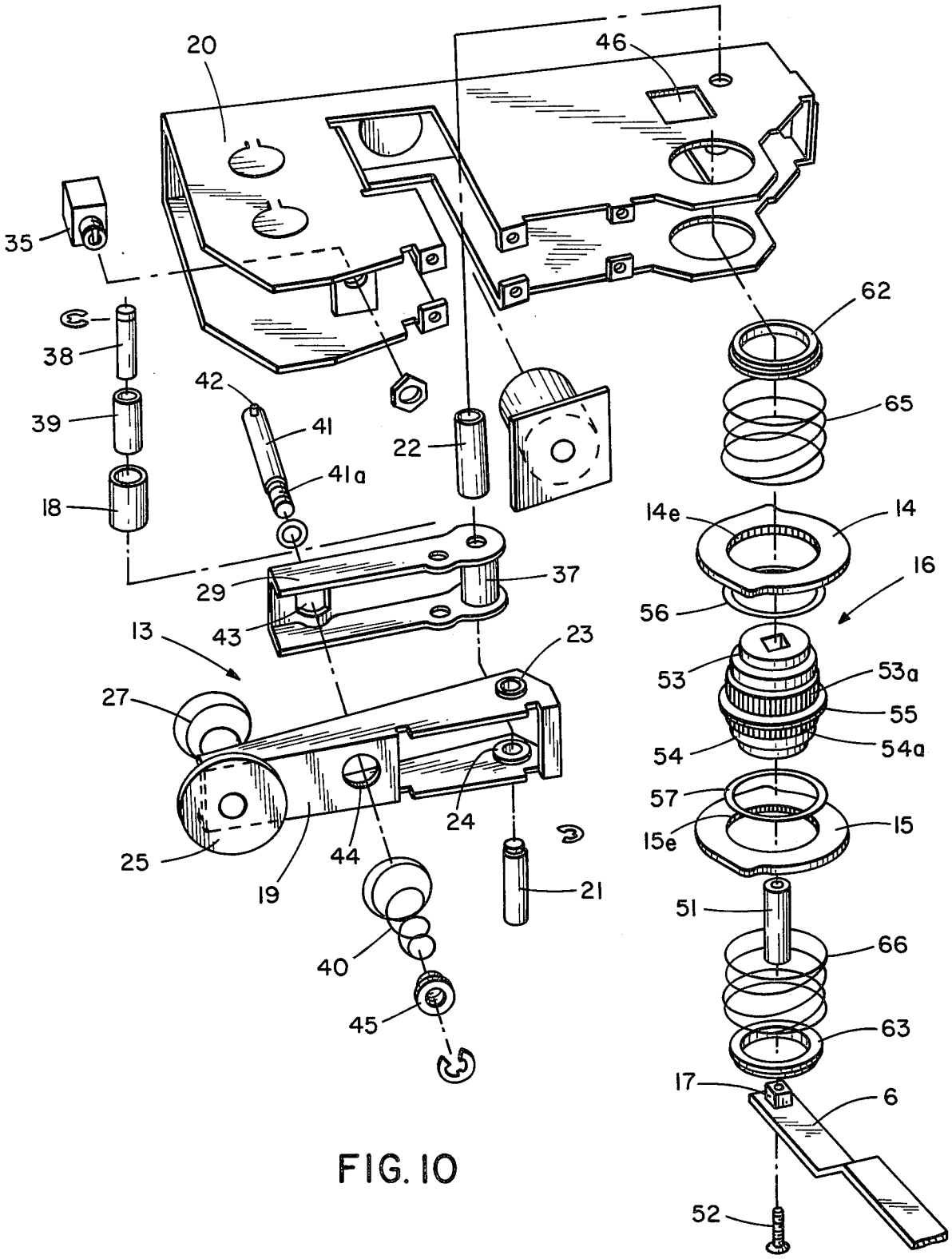
FIG. 10 is an exploded view of the holder and release of this invention.

In particular, as is shown in FIG. 4, and also FIGS. 6, 10 and 11, double lever 13 comprises latching lever 19 and manual override lever 29. Latching lever 19 and override lever 29 are pivoted relative holder and release frame 20 on a pivot point or fulcrum defined by pin 21 which extends from both walls of frame 20 (see FIG. 8) and is retained on the frame by an E-ring. A cylindrical rotatable plastic bushing 22 envelopes pin 21. Bushing 22 is also sandwiched between plastic bearings 23 and 24.

Figure 8:
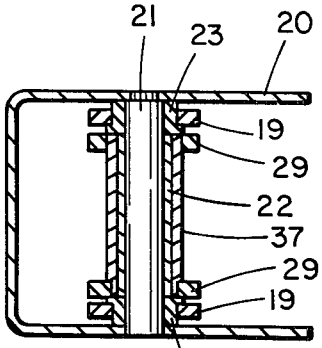
FIG. 8 is a section view taken along line 8—8 of FIG. 4 which shows details of the pivot assembly for the double lever which effects hold-open and manual override.

The extremeties of latching lever 19 are carried on plastic bearings 23 and 24 so that this lever may pivot relative pin 21 which is supported on frame 20 (FIG. 8). As is viewed in FIG. 4, the left end of latching lever 19 carries an adaptor pin 25 which projects through the metal wall of latching lever 19. The lower portion of pin 25 fixedly carries circular armature plate 26 and the upper portion of pin 25 serves as a seat for armature biasing spring 27.

Frame 20 is also formed with an embossed spring retaining seat 28 which holds the upper end of biasing spring 27. Accordingly, spring 27 is captured and held between the upper end of adaptor pin 25 and seat 28. Spring 27 normally holds armature plate 26 into contact with the core (not shown) of electromagnet 30. Spring 27 serves no other function and therefore the spring is relatively weak.

Electromagnet 30 is mounted on frame 20 by mounting plate 31 and the set of securing screws 32.

Single-throw toggle switch 35 is mounted on frame bracket 36. This switch electrically interconnects a power source with electromagnet 30 in a conventional circuit arrangement so that manual operation of the switch toggle can selectively energize or deenergize electromagnet 30.

When electromagnet 30 is energized, as is shown in FIG. 4, armature plate 26 is magnetically attracted to the adjacent contacting face of the electromagnet with a strong magnetizing force and, inasmuch as plate 26 is fixed to the left end of latching lever 19 by adaptor pin 25, roller 18 is held in firm contact against the adjacent contour surfaces of cam 14 and also cam 15.

When electromagnet 30 is deenergized, as is shown in FIG. 11, armature plate 26 is released from contacting engagement with electromagnet 30; accordingly, cam follower roller 18 is cammed away from detent portion **14*c* and rides over lobe 14*a* so that holder arm 6 is moved in the door-close arrow direction, thereby enabling closer 5 to door 4. It should be noted in this door closing operation effected by the deenergization of electromagnet 30, cam roller follower 18 pivots about the fulcrum or pivot point defined by pin 21**.

In an alternate energizing circuit for holder and release mechanism 1, electromagnet 30 can also be normally energized in a manner well known in the art by a smoke detector circuit arrangement contained within module **1*a* (not shown). When module 1*a* detects smoke, the detector circuitry deenergizes electromagnet 30, thereby effecting a release function identical to that shown in FIG. 11**.

As will be recalled, lever assembly 13 comprises two levers (see FIG. 10), namely, latching lever 19 and manual override lever 29, which pivot about the fulcrum or pivot point formed by pin 21. As is shown in FIGS. 4, 6, 10 and 11, override lever 29 is shorter in length than lever 19 and is generally housed within lever 19. The right end of lever 29 sandwiches a staked metal spacer sleeve 37 which houses pin 21 and bearings 22 and 23, as is shown in FIG. 8.

Figure 7:
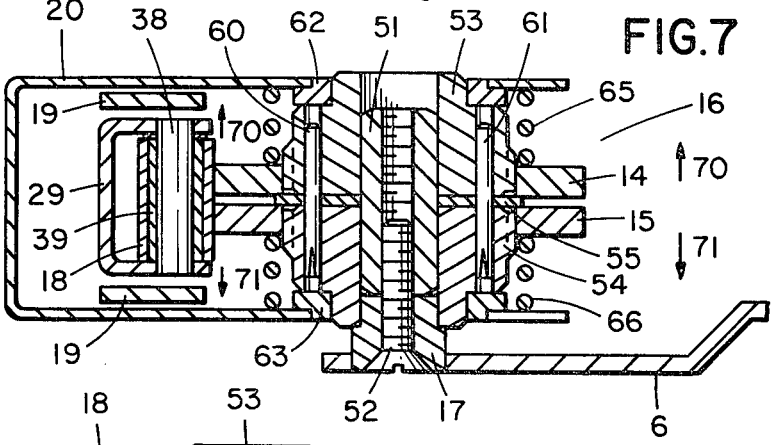
FIG. 7 is a sectional view taken along line 7—7 of FIG. 4 which shows sectional details of the spindle gear assembly and the cam-follower roller assembly.
Figure 9:
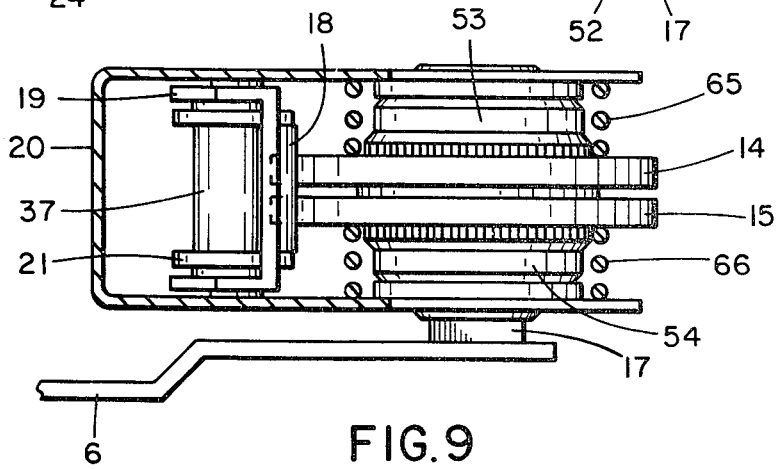
FIG. 9 is a view taken along line 9—9 of FIG. 12 which shows the relationship of the spindle gear, the cam-follower and the double lever in a push-side mounted door.

As best shown in FIGS. 6 and 7, cam follower roller 18 is rotatably mounted on override lever 29 by a concentric disposition of components which includes shaft 38, which extends between both sides of lever 29 and is retained in place by an E-ring and a concentrically disposed plastic bushing 39 which is located between shaft 38 and roller 18. Roller 18 is rotatably fixed a relatively short distance from the pivot point defined by pin 21 for both levers 19 and 29.

The hold-open force exerted by roller 18 against cams 14 and 15 is determined by a hold-open spring assembly which includes helical spring 40 carried on T-yoke 41 (FIG. 4). Yoke 41 carries at its extremity a transverse pin 42 which is pivotally seated in a saddle formed on the back side of override lever 29. As is shown in FIG. 10, T-yoke 41 passes through opening 43 located in lever 29 and also opening 44 located in lever 19. Pin 42 is retained against the back side of lever 29 and the main shank portion of yoke 41 receives helical spring 40. A threaded reduced shank portion **41*a* receives hold-open adjustment nut 45. Accordingly, with this disposition of components a rotation of hold-open adjustment nut 45 effects a greater or lesser compression of spring 40 inasmuch as this spring is sandwiched between a supporting surface on latching lever 19 and an enlarged head on hold-open adjustment nut 45. This spring force is transmitted to the left end of override lever 29 by pin 42. Accordingly, the degree of force which must be exerted by the lobes of cams 14 and 15 against roller 18 can be manually adjusted by effecting the proper degree of hold-open compression of spring 40**.

In FIG. 4, spring 40 is shown in a position in which manual override lever 29 is disposed in latching lever 19. In this disposition, roller 18 is not subjected to a sufficient camming force to compress spring 40 sufficiently to enable lobe **14*a* to force lever 29 upwardly and away from lever 19 which is held in engagement with electromagnet 30. However, and in contrast, in FIG. 6 which indicates a manual override situation, a sufficient door closing force has been applied to door 4 so that holder arm 6 is rotated in the door-closed direction and cam lobe 14*a* exerts a sufficient elevating force against cam follower roller 18 so that spring 40 is compressed and the left end of manual override lever 29 is elevated relative latching lever 19 so that the hold-open position of the door identified by the relative disposition of roller 18 within detent 14*c* (FIG. 4) has been overcome and the cams 14 and 15** are rotated clockwise so that the door can be closed by manual override.

In FIG. 11, the assembly of hold-open components comprising hold-open spring 40 and hold-open adjusting nut 45 retains both levers 19 and 29 in the same relative disposition. However, deenergization of electromagnet 30 enables the combination of levers 19 and 29 to be released and rotated clockwise about the pivot point defined by pin 21 so that cams 14 and 15 are rotated in a clock-wise direction with holder arm 6 moved in the door-closed direction. In this instance, cam lobe **14*a* elevates roller 18 in view of the fact that the electromagnet does not apply a holding force on the combination levers 19–29**.

The principal structural assembly for enabling single or multi-point door holding both in push and pull-mounted installations without removal of hold and release mechanism 1 or 2 and also their associated closers 5 and 10 is attained by the unique design of spindle gear assembly 16. Referring principally to FIGS. 5, 7, 9 and 10, spindle gear assembly 16 comprises principally an internally threaded cylindrical spindle post 51. Holder arm 6 is coupled to spindle 17, and spindle 17 and spindle post 51 are fixed together by screw 52. Two male spline gears 53 and 54 are carried on spindle post 51. The exterior surfaces of these gears are formed with equally spaced grooves or splineways so as to form a series of projecting keys 53*a* and 54*a* respectively (see FIG. 10). A circular ring-like spindle spacer 55 separates spline gears 53 and 54 from one another.

Hold-open cams 14 and 15 are each formed with a central opening, the internal periphery of which contains a series of female grooves which mate with the keys 53*a* and 54*a*, respectively, when spindle gear 16 is assembled. Rubber rings 56 and 57 rest on circular spaced 55 and cams 14 and 15 contact these rings in the assembly.

As is shown in FIG. 7, drive lock pins 60 and 61 lock fixedly male spline gears 53, 54 circular spacer 55 and rings 56 and 57.

Spline gears 53 and 54 are supported on frame 20 by a pair of plastic bearings 62 and 63. This bearing arrangement enables the arm 6 to convey a rotating force through spindle 17 to both spline gears 53 and 54. Spindle 17 is housed within either bearing 62 or 63 depending upon pull mount or push mount.

Helical cam retaining spring 65 is sandwiched between cam 14 and frame 20 and helical cam retaining spring 66 is sandwiched between lower cam 15 and frame 20.

Inasmuch as the cam lobes and also the cam detent portions of both cams 14 and 15 determine the hold-open points for holder and release mechanism 1, it is essential that cams 14 and 15 be rotatable relative their driving spline gears 53 and 54.

This function is attained (FIG. 7) after holder and release unit 1, for example, has been applied in a pull-mounted installation as is shown in FIGS. 1 and 2 by manually elevating cam 14 in the direction of arrows 70 and rotating cam 14 as hereinafter outlined. Similarly, cam 15 is depressed in opposition to spring 66 in the direction of arrows 71 so that cam 15 is removed from the key of spline gear 54 and can be rotated manually. After a proper location of the cam lobes has been attained to effect the desired holdopen angles, both cams 14 and 15 are returned to a mating enegagment with their associated spline gears 53 and 54. Springs 65 and 66 will hold the cams on the splineways and against rubber rings 56 and 57 which sandwich circular spacer 55.

In view of the fact that the holder and release mechanism of this invention is non-handed and can be both pull-mounted and push-mounted, hold open cams 14 and 15 are necessarily divided into two segments (See FIG. 4) denominated "pull-side" and "push-side." Segment lines 14*f* and 14*g* which are diametrically opposite one another divide the cams in these two specified halves. In those installations in which a pull-side mount is required, the push-side cam lobe must be located roughly in the area of cam follower 18, and the pull-side cam lobe must be visible from the side of frame 20. Thereafter, specific incremental rotating adjustments in the cam are made to provide the precise required hold-open angle.

An example of the specific steps required to appropriately adjust cam 14 for a single point 90° hold-open setting in a pull-mounted installation as is shown in FIGS. 1 and 2 are as follows:

1. Initially the power applied to electromagnet 30 must be turned off by appropriate operation of toggle switch 35.

2. Assuming that the single point hold-open at 90° is to be effected by the upper cam 14 and not the lower cam 15, door 4 should be placed in the closed position.

3. The upper hold-open cam 14 is elevated in the direction of arrows 70 as is shown in FIG. 7 in opposition to spring 65 until the cam is removed from engagement with the keys of spline gear 53.

4. Cam 14 is thereafter rotated until the pull-side segment is visible at the outer edge of frame 20. Then the cam is lowered.

5. Thereafter door 4 is opened manually to the hold-open point or angle desired and the upper cam is elevated again and rotated until the pocket or detent portion 14*c* of the cam is in a position next to roller 18 as is shown in FIG. 4. Thereafter cam 14 is depressed downwardly so as to reengage the keys of spline gear 53.

6. Cam 15 must thereafter be lowered in the direction of arrows 71 and in opposition to spring 66 and rotated approximately 90° from the adjustment of the lobe 14*a* of cam 14. This latter adjustment will remove cam 15 from any operative hold-open function.

7. The power is then applied to electromagnet 30 by appropriate operation of toggle switch 35.

8. Door 4 should thus be at the 90° hold-open angle, and the door should stay in hold-open so long as power is applied to electromagnet 30. If the hold-open degree is incorrect, repeat the prior steps by incrementally adjusting hold-open cam 14 until the proper hold-open setting is attained.

Door 4 should close freely from hold-open settings to fully closed when the power is removed or manual override is effected. Adjusting nut 45 should be appropriately rotated to increase hold-open poundage if manual override is effected too easily or, alternatively the adjusting nut can be rotated in an opposite direction to lower the hold-open poundage in the event that an excessive manual override force is required.

In the event that a two-point hold-open is required, for example at 35° and also at 90°, the foregoing steps are repeated with respect to cam 14 in order to effect the 90° hold-open position. Additionally, in order to effect the 35° hold-open position, the following steps are required:

The lower cam 15 should be set by following the same basic steps previously followed with respect to upper cam 14; however, the lower cam will be disengaged by lowering the cam rather than raising the cam. Additionally the final setting of the cam should be effected when cam 15 is push-side mounted when viewed from the edge of frame 20, but with detent 15*c* adjacent roller 18 at a hold-open angle of approximately 35°. That is, the detent 15*c* of hold-open cam 15 is located adjacent roller 18 when door 4 is open at a 35° angle.

Assuming that holder and release 1 and its cams 14 and 15 have been appropriately adjusted to 35° and 90° hold-open positions, the sequence of operations shown in the related drawings of FIGS. 13, 14 and 15 will further assist in an understanding of the two-point, hold-open operational sequences for a pull-side mounted holder release. FIG. 13 shows a closed door. FIG. 14 shows an approximately 35° hold-open door position, and FIG. 15 shows an approximately 90° hold-open door position.

Referring to FIG. 13, it will be noted that both cams 14 and 15 are in such a position relative to roller 18 that none of the detent portions of the cams engage the roller when the door is closed. However, as door 4 is opened to an approximately 35° angle (FIG. 14), holder arm 6 rotates the cams in a counterclockwise direction so that cam 15 and its detent portion 15*c* receives roller 18. In this relative disposition of the components, door 4 is held open at a 35° angle by lower cam 15. As the door is further rotated to a 90° open position, there is a relative counterclockwise movement of both cams 14 and 15 until roller 18 is now engaged in the pocket or detent portion 14*c* of cam 14, at which time the door is held open at the 90° angle (FIG. 15).

Release of the door in both of the positions shown in FIGS. 14 and 15 can be effected as previously explained, by deenergizing electromagnet 30 or alternatively manually overriding the cam lock by applying a door closing force against door 4 in opposition to the hold-open force applied by spring 40.

The detailed operation of holder and release unit 1 as a push-side mount and the adjustment of cams 14 and 15 with respect to the spindle gear assembly 16 has been described. However, in view of the fact that the holder and release is non-handed and that a unit identical to unit 1 can be push-mounted, it facilitates an understanding of the universal adaptability of the holder and release unit to discuss briefly its operation and adjustment as a push-mounted unit. Accordingly, holder and release unit 2 as push-mounted in FIGS. 1, 2 and 3 of the drawings is described in detail with reference to FIGS. 9, 12 and 16 and 17.

Figure 12:
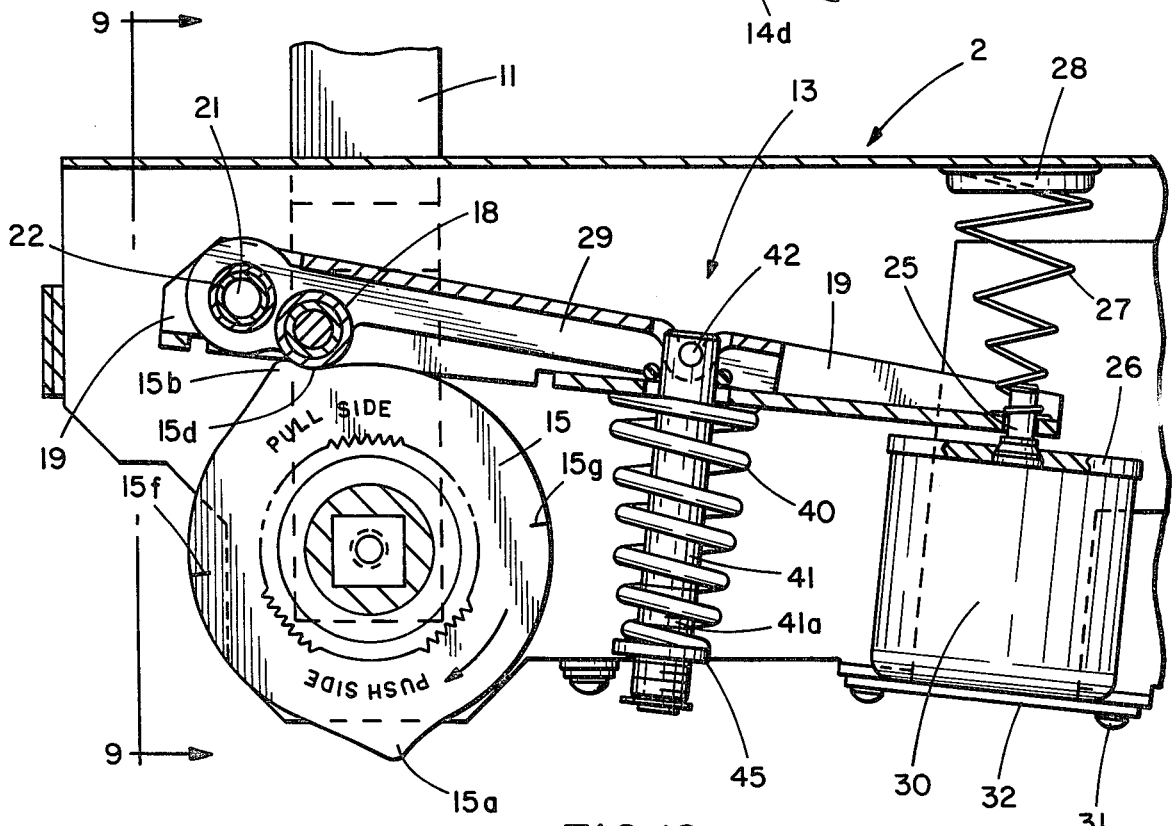
FIG. 12 is a view showing the holder and release of the prior Figures applied in a push-side mounting with the door in a 90° hold-open position.

FIG. 12 shows holder and release unit 2 which is identical in structure to that of unit 1 applied in a push-side mount with door 10 in a 90° hold-open position generally as is shown in FIGS. 1 and 2. As previously set forth, when the unit is push-side mounted generally only a single point hold-open can be effectively obtained from the structure. In view of the fact that unit 2 is identical to the structure of unit 1 except that it is reversed, identical reference numerals are used for identical parts. Accordingly, cam 15 which is the lower cam in the Figures showing the operation of the device as a pull-mounted device, becomes the upper cam when the unit is push-mounted as is shown in FIGS. 12, 16 and 17.

When the device is so mounted, cam lobe 15*b* is adjacent follower roller 18 with the roller latched in pocket or detent 15*d*. It should be noted in this instance the push-side of the cam is defined by diametric dividing lines 15*f* and 15*g* located adjacent the roller. The location of the push-side of the cam adjacent roller 18 is again effected by removing the housing cover and rotating the cam until the push-side segment is visible at the outer edge of frame 20. Cam 15 is adjusted in a push-side mount in a manner identical in basic principle to that previously described with respect to the pull-side mount. The only major exception is that inasmuch as only a single point hold-open is effected cam 14 which is now the lower cam, becomes non-functional. Cam 14 must therefore be rotated to a non-functional position when door 9 rotates from its door closed position to the door open 90° position.

FIGS 16 and 17 show the sequence of operation of the principal components when door 9 is moved from the closed position shown in FIG. 16 to the 90° hold-open position shown in FIG. 12 and also in FIG 17.

Referring to FIG. 16, it is seen that cam 15 which is the upper cam assumes a position in which lobe 15*b* is approximately 90° removed from roller 18 and that roller 18 is located substantially adjacent to push-side dividing line 15*f*. As in the case of cam 14, cam 15 is also divided into push and pull segments which are defined by diametric lines 15*f* and 15*g*. Cam 14 or the lower cam in this application, is rotated approximately 35° behind cam 15 in the counterclockwise rotational sequence. Accordingly, cam lobe 15*b* is approximately at 3 o'clock whereas trailing cam lobe 14*b* is approximately at 4 o'clock.

As door 9 is opened to the 90° position (FIG. 17) both cams 15 and 14 rotate counterclockwise and cam lobe 15*b* elevates cam roller 18 into the pocket or detent segment 15*d* so that door 9 is held open at the 90° angle. In view of the fact that trailing cam lobe 14*b* is disposed so that it will not be in effect during a 90° opening, this cam serves no function in the push-mount operation of the device.

The electromagnetic release and also the manual override of the holder and release mechanism 2 is identical in basic function to that previously described with respect to holder and release unit 1.

Sectional view 9 taken along line 9—9 of FIG. 12 shows the relationship of the spindle gear, the hold-open roller and the double lever pivot assemblies when the components are in the positions shown in FIG. 12 and also in FIG. 17.

It should be understood that the above described arrangements are merely illustrative of the principles of this invention, and that modifications can be made without departing from the scope of the invention.

What is claimed is:

1. An electrically-actuated door holder and release including a rotatable spindle adapted to be connected to a pivoted door which is to be held open at desired hold open angles or points, comprising a spindle gear assembly having a spindle gear with the gear having a circular ring of splineways forming a series of male projecting keys, a cam having a cam lobe defining a detent segment with the cam having a circular hole internally grooved to mate with the projecting keys of the gear, a spring yieldingly holding the cam into a mating position with the spline gear to rotate therewith, an electromagnet, an armature, a pivoted latching lever supporting the armature and carrying a cam roller with energization of the electromagnet attracting the armature to latch the roller into a cam latching position on the detent segment thereby yieldingly latching the spindle gear assembly and the spindle against further rotation to hold a door at a desired open position.

2. The combination of claim 1 in which the spindle gear assembly has two substantially identical spline gears, two substantially identical cams with each cam mating with a different gear and a pair of springs each yieldingly holding an associated cam into operative engagement with its associated gear, a spindle post supporting both shaft segments and cams on a common rotatable axis, and the cam roller being movable into a cam latching position on the detent segments of both cams thereby yieldingly latching the spindle gear assembly and the spindle against further rotation to hold a door at a plurality of desired open positions.

3. The combination of claim 1 including a holder and release frame, a pair of bearings rotatably supporting the spindle gear assembly on the frame with the spring being disposed between the cam and the frame whereby manual movement of the cam relative its mating spline gear to compress the spring enables independent rotating movement of the cam to thereby vary the cam lobe position relative the spindle gear assembly.

4. The combination of claim 2 including a holder and release frame, a pair of bearings rotatably supporting the spindle gear assembly on the frame with each spring being disposed between a different cam and the frame whereby manual movement of either or both cams relative its mating spline gear to compress either or both springs enables independent movement of any disengaged cam to thereby vary the cam lobe positions relative the spindle gear assembly.

5. The combination of claim 1 in which a second override lever supports the cam roller and both the override lever and the cam roller are carried on the latching lever with both levers having a common pivot point, and an adjustable spring assembly yieldingly coupling both levers one to the other so that rotation of a cam lobe over the roller pivots angularly the override lever relative the latching lever when the electromagnet is energized.

6. The combination of claim 2 in which a second override lever supports the cam roller and both the override lever and the cam roller are carried on the latching lever with both levers having a common pivot point, and an adjustable spring assembly yieldingly coupling both levers one to the other so that rotation of a cam lobe over the roller pivots angularly the override lever relative the latching lever when the electromagnet is energized.

7. The combination of claim 3 in which a second override lever supports the cam roller and both the override lever and the cam roller are carried on the latching lever with both levers having a common pivot point, and an adjustable spring assembly yieldingly coupling both levers one to the other so that rotation of a cam lobe over the roller pivots angularly the override lever relative the latching lever when the electromagnet is energized.

8. The combination of claim 4 in which a second override lever supports the cam roller and both the override lever and the cam roller are carried on the latching lever with both levers having a common pivot point, and an adjustable spring assembly yieldingly coupling both levers one to the other so that rotation of a cam lobe over the roller pivots angularly the override lever relative the latching lever when the electromagnet is energized.

9. In an electrically actuated door holder and release for the single or multi-point holding of a pivoted door, the improved adjustable hold-open latch comprising a shaft adapted to be rotatable responsively to door open angles, a gear formed with a key attached to the shaft, a cam having one or more detent pockets with means for engaging the key, a spring engaging the cam and enveloping the shaft and in which an expanded spring normally drives the cam into engagement with the gear, and in which compression of the spring by manual movement of the cam to disengage the key enables the cam to be rotated manually independently of the gear to alter the relative positional engagement of the cam and the gear, and a pivoted latching lever, a cam follower supported on the pivoted lever, and means when electrically energized forcibly driving the cam follower against the cam to effect door hold-open when the follower is lodged in a detent pocket.

* * * * *